US007681427B2

(12) United States Patent
Op de Hipt et al.

(10) Patent No.: US 7,681,427 B2
(45) Date of Patent: Mar. 23, 2010

(54) METHOD AND DEVICE FOR THE PRODUCTION AND/OR MACHINING OF PIECES

(75) Inventors: Michael Op de Hipt, Evilard (FR); Rudolf Welk, Illertissen (DE)

(73) Assignee: Feintool International Management AG, Lyss (CH)

( * ) Notice: Subject to any disclaimer, the term of this patent is extended or adjusted under 35 U.S.C. 154(b) by 162 days.

(21) Appl. No.: 11/576,532

(22) PCT Filed: Oct. 5, 2005

(86) PCT No.: PCT/EP2005/010872

§ 371 (c)(1),
(2), (4) Date: Jun. 1, 2007

(87) PCT Pub. No.: WO2006/040105

PCT Pub. Date: Apr. 20, 2006

(65) Prior Publication Data

US 2009/0025447 A1 Jan. 29, 2009

(30) Foreign Application Priority Data

Oct. 7, 2004 (DE) ..... 10 2004 049 149

(51) Int. Cl.
*B21D 24/10* (2006.01)
*B21D 24/16* (2006.01)

(52) U.S. Cl. ..... 72/327; 72/350; 72/352; 72/453.13; 100/259; 267/119

(58) Field of Classification Search ..... 72/327, 72/333, 334, 350, 352, 453.13, 351; 83/137, 83/639.5, 685; 100/259; 267/119
See application file for complete search history.

(56) References Cited

U.S. PATENT DOCUMENTS

| | | | | |
|---|---|---|---|---|
| 4,111,024 | A | 9/1978 | Dahlmam et al. | |
| 4,489,584 | A | 12/1984 | Gall et al. | |
| 5,054,353 | A | 10/1991 | Haack et al. | |
| 5,138,857 | A * | 8/1992 | Siegert | 72/21.1 |
| 5,247,862 | A | 9/1993 | Haack | |
| 5,295,383 | A * | 3/1994 | Kirii et al. | 72/351 |
| 2004/0094046 | A1 | 5/2004 | Aoshima et al. | |

FOREIGN PATENT DOCUMENTS

| | | |
|---|---|---|
| DE | 2713571 | * 10/1977 |
| DE | 41 28 973 | 4/1992 |
| DE | 197 51 238 | 5/1999 |
| DE | 199 29 163 | 1/2001 |
| DE | 10353350 | * 5/2007 |
| EP | 0 417 754 | 3/1991 |
| EP | 0418779 | * 3/1991 |
| JP | 57-175027 | 10/1982 |

* cited by examiner

*Primary Examiner*—David B Jones
(74) *Attorney, Agent, or Firm*—Bachman & LaPointe, P.C.

(57) ABSTRACT

A device for the production and/or machining of parts, in particular for the production of stampings, by at least one die which is capable of being put under pressure and/or force, and which has at least one plate and one die element, the die element being supported in the plate against pressure elements via a resilient element.

6 Claims, 1 Drawing Sheet

METHOD AND DEVICE FOR THE PRODUCTION AND/OR MACHINING OF PIECES

BACKGROUND OF THE INVENTION

The invention relates to a device for the production and/or machining of parts, in particular for the production of stampings, by means of at least one die which is capable of being put under pressure and/or force, and which has at least one plate and one die element, the die element being supported in the plate against pressure elements via a resilient element.

The present invention refers to all machines having a die by means of which parts are to be produced or machined under pressure. For example, the machining machines may be deep-drawing devices or the like. Particular reference is made, however, to stamping machines, in which stampings are produced in a die consisting of an upper and of a lower die part between which a material strip is clamped. Appropriate cutting or forming elements then press onto the material and separate it out or form it.

A subtype of stamping is fine blanking. A corresponding fine-blanking device is shown, for example, in DE 35 76 129 A1. A fine-blanking die is found in DE 197 51 238 A1.

Both EP-A-0 418 779 and Patent Abstracts of Japan BD 007 No. 020 (M-188), 26 Jan. 1983 (1983 Jan. 26)-&JP57 175027 A (TAKESHI OOSHIMA), 27 Oct. 1982 (1982 Oct. 27) disclose in each case a cutting or stamping die, in which a die element is supported against a pressure element via resilient elements and is thereby held with a clearance from a die plate.

Problems arise, inter alia, with regard to the introduction of forces into the die, that is to say the arrangement of the force-transmitting elements is greatly restricted. Conventionally, the dies are nowadays constructed as follows:

The knife-edged ring or pressure pad pressure cylinders are arranged centrically in the press body or ram. The transmission force from the pressure cylinder to the die takes place via what is known as an insert ring or a die plate which are arranged centrally above the pressure cylinder. The disadvantages of this central pressure cylinder arrangement is that force transmission cannot be co-ordinated with the die requirements. Furthermore, there is no possibility of dividing the work steps into a plurality of work steps independent of one another when different pressure intensities or strokes are required. This refers both to the number of force-transmitting elements and to their size and position. This rigid arrangement of the pressure cylinders results in the tipping or counting of the pressure plate when dies with eccentric load are used. In order to avoid this weak point, displaceable pressure pads have also already been used, but these have the serious disadvantage that the required outlay in terms of setting up is unacceptable, and the press body and the press ram are correspondingly weakened in their structure due to the large orifices, and the pad dimensions cannot be varied as desired.

The object on which the present invention is based is to develop a method and a device of the type mentioned above, which allow a free and flexible arrangement and activation of the force-transmitting elements, so that stampings of any desired size and geometry can ultimately be manufactured.

SUMMARY OF THE INVENTION

The foregoing object is achieved wherein at least one crossbridge is arranged between the die element and at least two pressure bolts and is seated in the die displaceably opposite to the main pressure direction of the press.

The basic idea of the present invention is an array of force-transmitting elements, in which these may be executed in any desired number and in a variable arrangement and transmission area. The forces themselves which are transmitted by the force-transmitting elements may be generated hydraulically, pneumatically, by spring force, mechanically or electromotively. The force-transmitting elements can be adapted in their size and number correspondingly to the respective die concept. The individual force-transmitting elements can be both force-dependent and travel-dependent independently of one another and can be controlled and/or regulated according to the requirements of the die.

A corresponding device is composed of a plurality of individual force-transmitting machine elements (cylinders, springs) which are arranged so as to be distributed in any desired grid over the entire platen surface or ram surface of the press. The individual elements/stations can be controlled independently of one another or in any desired arrangement in a pressure-dependent and/or travel-dependent and/or force-dependent manner. The individual stations/elements can be connected to one another in any desired number and arrangement via bridge battens of varying length or moldings of any desired shape in the die change plates or in the die. A plurality of force transmission arrays independent of one another can thus be provided in a different length/extent and with a different force.

In order to cover each pressure bolt position of the individual die stages (modules), corresponding crossbridge battens (or moldings) are arranged in the die. These crossbridges are designed according to the individual die stages and are an integral part of the die.

By virtue of this construction, the following points can be covered:

- any desired number of force transmission arrays
- different forces of the individual transmission elements
- any desired extent/array size of the force transmission elements due to their coupling by means of the bridges described
- different travels/stroke lengths of the individual force transmission elements
- virtually any desired number and position of pressure bolts (pressure bolts=force transmission elements in the die)
- full-area die support.

The method according to the invention and the corresponding device have the great advantage that

- flexibility in the construction of a (fine-blanking) die can be increased considerably. The force-transmitting elements can be arranged entirely freely in terms of their position according to the requirements arising from the stamping geometry. This arbitrary arrangement allows an optimal configuration of the process steps and of the die.
- the capacity to produce fine stampings is no longer limited by the geometric restrictions in the die construction or reduced by restrictions in the arrangement of the process steps in the die.
- the die construction can become simpler. A plurality of process steps which are partly integrated into a die stage in present-day progressive dies can be corrected. As a result, process reliability can be increased, the outlay for co-ordinating the die elements can be reduced and setting-up times can be shortened.

contrary to nowadays, the die is supported over the entire bearing surface and the precision of the parts and the service life of the die are thereby increased.

BRIEF DESCRIPTION OF THE DRAWINGS

Further advantages, features and details of the invention may be gathered from the following description of the preferred exemplary embodiment and with reference to the drawing in which.

DETAILED DESCRIPTION

Figures 1, 2:
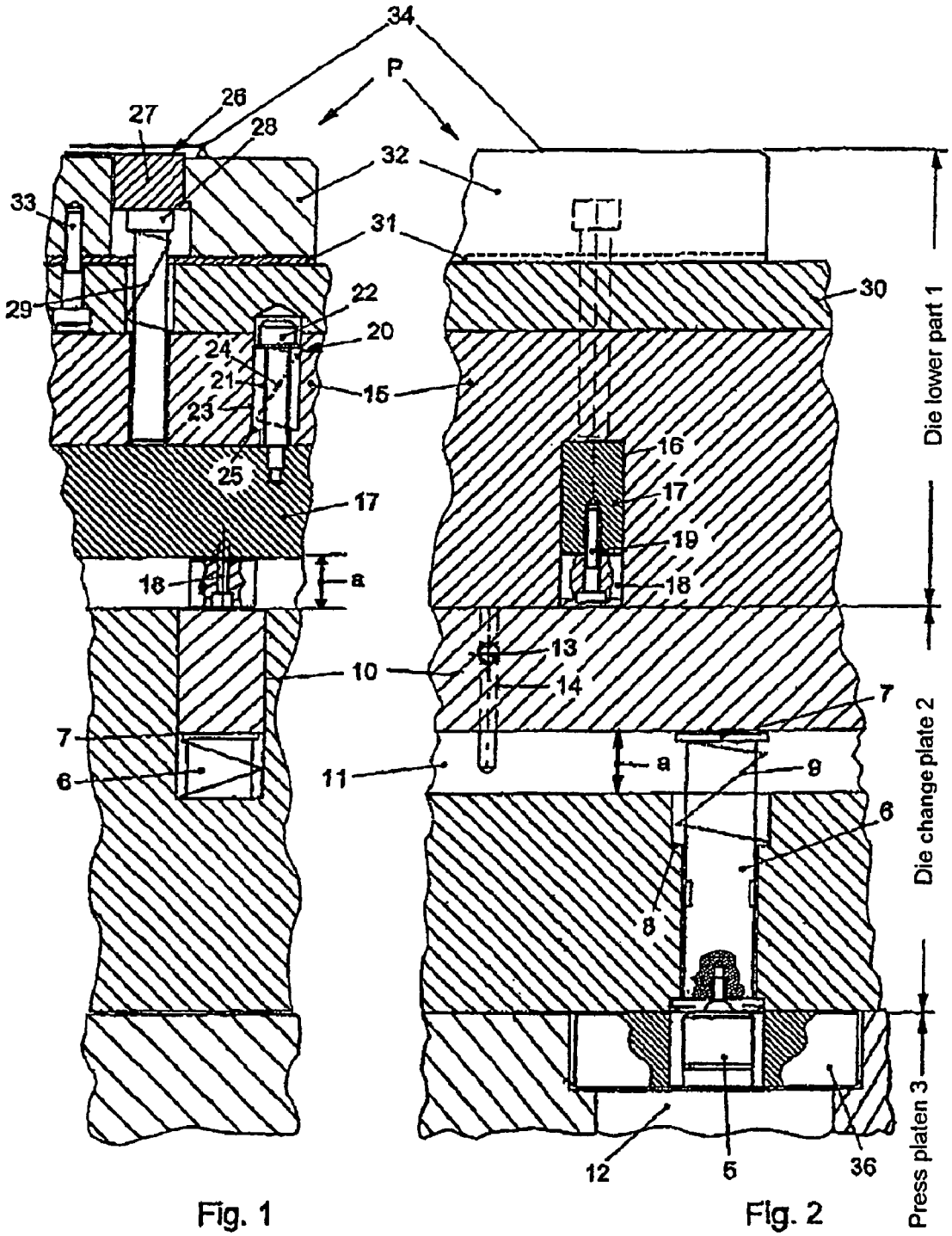
FIG. 1 shows a partially illustrated cross section through a device according to the invention for the production and/or machining of parts.
FIG. 2 shows a partially illustrated cross section through the device according to FIG. 1, but rotated through 90°.

Of the device P for the production and/or machining of parts, FIGS. 1 and 2 show a die lower part 1, a die change plate 2 arranged beneath it and a press platen 3 arranged beneath the die change plate 2. The die change plate 2 is preferably connected to the press platen 3 via T-strips which engage at least partially into T-grooves. How this takes place is illustrated, for example, in DE 36 62 351 A.

A ram 12 and, in this, a pressure force ram 5, for example a further hydraulic ram, are guided in the press platen 3. A ring 36 surrounds the pressure force ram 5 in the position of use.

In the press platen 3 are arranged a plurality of pressure force rams 5, above each of which is seated a pressure bolt 6 which is guided and held in the die change plate 2. Between a head 7 on the pressure bolt 6 and a shoulder 8 in the die change plate 2 is located a supporting spring 9 which holds the pressure bolt 6 in a supported position. In this supported position, the pressure bolts 6 support a crossbridge 10, so that a free space 11 is located between the crossbridge and the die change plate 2 due to the formation of a clearance a. This supporting position of the pressure bolt 6 allows a frictionless change of the die change plate 2 together with the crossbridge 10, since the pressure bolts 6 do not hang out of the die change plate 2 downward.

The crossbridge 10 is equipped with a sprung ball thrust screw 13. This ball thrust screw 13 latches into a groove 14 of the change plate 2 and thus fixes the crossbridge 10.

The length of the crossbridges 10 are designed according to the die requirements such that they cover two or more pressure bolts 6.

On the crossbridge 10 lies a frame 15. In this frame 15 can be seen a compartment 16 in which a pressure bolt bridge 17 is guided displaceably. The pressure bolt bridge 17 is supported against the crossbridge 10 via a bearing mushroom 18, the bearing mushroom 18 being connected to the pressure bolt bridge 17 by means of a screw bolt 19. The bearing mushroom 18 has the effect that the pressure bolt bridge 17 likewise maintains a clearance a from the surface of the change plate 2. This clearance also corresponds to the clearance a of the crossbridge 10 in the free space 11 of the change plate 2. It defines the maximum pressure pad stroke.

The shape of the compartment 16 and of the pressure bolt bridge 17 is governed by the respective die requirements. In the same way as the crossbridge, the pressure bolt bridge also need not be a straight molding, but, instead, moldings of any desired shape may be envisaged, for example oval, round or at an angle to one another. The compartments 16 and free spaces 11 then also have corresponding configurations.

Furthermore, in FIG. 1, a recuperator 20 can be seen for the pressure bolt bridge 17. This recuperator has a screw bolt 21 which is screwed into the pressure bolt bridge 17. The head 22 is supported via a helical spring 24 against a lower step 25 of this stepped bore 23.

By virtue of this embodiment, the pressure bolt bridge 17 together with the bearing mushrooms 18 is drawn upward, and the lower edge of the bearing mushrooms 18 is flush with the lower edge of the frame 15 or of the die lower part 1. As a result, the die lower part 1 can easily be pushed out and in for the die change.

A die element 26, which is an ejector in the present exemplary embodiment, presses onto the pressure bolt bridge 17 via a bolt 28. Of this ejector, an ejector ring 27 is shown which lies on a pressure bolt 28. The ejector ring 27 can be pressed against the pressure bolt bridge 17 via this pressure bolt 28. It is pressed back into the initial position by means of a helical spring 29.

The pressure bolt 28 passes through a baseplate 30 which lies on the frame 15. This baseplate 30 is connected to a die proper 32 via height compensation 31, this taking place by means of a corresponding screw bolt 33. A knife-edged ring 34 for fine blanking can be seen on the die proper 32.

The present invention functions as follows:

If, for example, a part is to be stamped out, in particular fine-blanked, from a metal sheet, a fine-blanking device is used, such as is described by way of example in DE 35 76 129 A. The corresponding die consists there of two die halves, to be precise of an upper and of a lower die half, and the device according to the invention may be used in both die halves, but it is also within the scope of the invention for the device according to the invention to be used only in one die part.

If, then, a fine-blanking operation is carried out, the two die halves are brought together, the metal sheet, from which the part is to be cut out, being arranged between the two die halves. The die proper 32 co-operates with a counter element, a considerable pressure/force being exerted on the die proper 32 and also on the die element 26. According to the invention, this pressure/force is transmitted via the height compensation 31 and the baseplate 30 and also via the frame 15 to the crossbridge 10 which, in turn, absorb forces (for example, also a tipping force or unequal forces) in that the pressure bolts 6 of the pressure force ram 5 yield correspondingly. This yielding takes place in the region of the free space 11 due to a reduction in the clearance a between the crossbridge 10 and die change plate 2.

If unequal forces are transmitted to the die element 26, a transfer of these forces takes place here via the pressure bolt bridge 17 and the bearing mushroom 18 to the crossbridge 10 and from the latter, in turn, to the pressure force element 5 via the pressure bolt 6. An ideal compensation of uneven forces thus takes place.

The number and arrangement of the pressure bolt 6 and of the pressure force ram 5 may be assigned to the individual die workstations via the crossbridge 10. The pressure bolt bridges 17 can then be adapted to the requirements of each workstation.

A particular configuration is additionally provided for the pressure force ram 5. This is preferably received in a hydraulic cylinder in the ram 12. For example, three pistons are seated on it, each piston possessing a specific pressure space which can be acted upon with a pressure medium. As a result, a force on the pressure force ram 5 is increased substantially and counteracts the penetration of the pressure bolt 6.

The invention claimed is:

1. A device for the production of stampings comprising:

a lower die part (1);

a die change plate (2) arranged beneath the lower die part (1);

a press platen (3) arranged beneath the die change plate (2);

a die element (26) supported in the lower die plate (1);

a pressure force ram (5) arranged in the press platen (3) and bears against at least one pressure bolt (6) in the die change plate (2);

a crossbridge (10) arranged between the die element (26) and the at least one pressure bolt (6), wherein the at least one pressure bolt bears on the crossbridge; and the crossbridge (10) is provided with a latching element (13) which cooperates with a corresponding recess (14) in the die change plate for fixing the crossbridge thereto.

2. The device as claimed in claim 1, wherein a pressure bolt bridge (17) is seated on the crossbridge (10).

3. The device as claimed in claim 2, wherein the pressure bolt bridge (17) is seated in a compartment (16) in the die lower part (1) and is supported at one end by the crossbridge (10) against the die element (26).

4. The device as claimed in claim 2, wherein a recuperator (20) is fixed to the pressure bolt bridge (17).

5. The device as claimed in claim 3, wherein the pressure bolt bridge (17) is arranged in the compartment (16) in a frame (15) between the die element (26) and the crossbridge (10).

6. The device as claimed in claim 5, wherein a baseplate (30) lies on the frame (15) and is connected to a die proper (32) by a height compensation (31).

* * * * *